US008983104B2

(12) United States Patent
Shimamura

(10) Patent No.: US 8,983,104 B2
(45) Date of Patent: Mar. 17, 2015

(54) RING-SHAPED SPEAKER HAVING TWO VOICE COILS AND CONTROL MEMBER

(75) Inventor: Naoki Shimamura, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 119 days.

(21) Appl. No.: 13/186,195

(22) Filed: Jul. 19, 2011

(65) Prior Publication Data

US 2012/0128183 A1 May 24, 2012

(30) Foreign Application Priority Data

Nov. 18, 2010 (JP) ..... 2010-257775

(51) Int. Cl.

| | |
|---|---|
| ***H04R 1/20*** | (2006.01) |
| ***H04R 1/32*** | (2006.01) |
| ***H04R 7/18*** | (2006.01) |
| *H04R 7/12* | (2006.01) |

(52) U.S. Cl.

CPC ..... *H04R 1/323* (2013.01); *H04R 7/12* (2013.01); *H04R 7/18* (2013.01)

USPC ..... 381/343; 381/339

(58) Field of Classification Search

CPC ..... H04R 1/32; H04R 1/323; H04R 1/34; H04R 1/345

USPC ..... 181/152–153, 159, 177, 184–185, 187, 181/192, 196; 381/162, 337–345

See application file for complete search history.

(56) References Cited

U.S. PATENT DOCUMENTS

| | | | | |
|---|---|---|---|---|
| 3,909,530 | A * | 9/1975 | Gosswiller | 381/342 |
| 6,320,970 | B1 * | 11/2001 | Czerwinski et al. | 381/343 |
| 6,320,972 | B1 | 11/2001 | Goller | |
| 2002/0175021 | A1 * | 11/2002 | Moritake et al. | 181/153 |
| 2006/0067558 | A1 * | 3/2006 | Shimamura | 381/396 |
| 2006/0274914 | A1 * | 12/2006 | Horigome et al. | 381/424 |

FOREIGN PATENT DOCUMENTS

| | | |
|---|---|---|
| JP | 58-186297 | 10/1983 |
| JP | 60-37989 | 3/1985 |
| JP | 62-24589 | 2/1987 |
| JP | 2006-100879 | 4/2006 |
| JP | 2006-101203 | 4/2006 |
| JP | 2009-171475 | 7/2009 |

OTHER PUBLICATIONS

Office Action from counterpart Japanese Patent Application No. 2010-257775 dated Mar. 4, 2014.

* cited by examiner

*Primary Examiner* — Ahmad F Matar
*Assistant Examiner* — Katherine Faley
(74) *Attorney, Agent, or Firm* — Brinks Gilson & Lione

(57) ABSTRACT

A speaker includes a ring-shaped vibrating member fixed to an internal support body at an internal peripheral edge, and a bobbin attached to an external peripheral edge thereof. A voice coil is attached to the bobbin and is located in a magnetic gap. A ring-shaped control member faces a front portion of the vibrating member, and a sound pass space is formed at an external peripheral side of the control member and at an internal peripheral side thereof. When listening to the speaker from a diagonal location, treble sound waves generated from the left side area are perturbed by the control member so as to prevent interference from sound waves generated from bilaterally separated areas, which prevents a decrease of treble sound pressure levels.

15 Claims, 4 Drawing Sheets

RING-SHAPED SPEAKER HAVING TWO VOICE COILS AND CONTROL MEMBER

PRIORITY CLAIM

This application claims the benefit of Japanese Patent Application No. 2010-257775, filed on Nov. 18, 2010, and which is incorporated by reference herein in its entirety.

BACKGROUND

1. Field of the Invention

The present invention relates to a speaker which includes a ring-shaped vibrating member, and in particular, relates to a speaker which can prevent decrease of sound pressure and deterioration of sound quality when listening at diagonal front.

2. Description of the Related Art

Speakers respectively utilizing a ring-shaped vibrating member have been disclosed in Japanese Patent Application Laid-open 2006-100879, Japanese Patent Application Laid-open 2009-171475, and U.S. Pat. No. 6,320,972.

The ring-shaped vibrating member is unlikely to cause divisional resonance compared to a circular dome-shaped vibrating member and to cause sound distortion. Accordingly, such a vibrating member is often used for a tweeter which generates sound mainly in a treble range as being formed in relatively small diameter.

Here, in a speaker utilizing a ring-shaped vibrating member, a part of the vibrating member exists respectively at both sides as sandwiching a center line when viewing a sectional view sectioned at a face including the center line. Accordingly, a sound-generating portion is to be located respectively at both sides as sandwiching the center line.

Accordingly, when listening sound from diagonal front being angled against the center line, interference is more likely to occur between a sound wave from a sound-generating portion at one side and a sound wave from a sound-generating portion at the other side as sandwiching the center line.

Since treble sound waves have short wavelength and high directivity, sound pressure is more likely to be decreased and sound quality is more likely to be deteriorated when listening at diagonal front owing to interference between sound waves from the sound-generating portions located at both sides as sandwiching the center line.

In particular, in a speaker system for automobile use, tweeters are often attached at diagonal front positions from an occupant (e.g., pillar portions at both sides of a front window). Accordingly, influence due to the abovementioned sound wave interference is apt to be obtrusive.

SUMMARY

To address the above issues, the present invention provides a speaker with a ring-shaped vibrating member having a structure in which sound pressure decrease and sound quality deterioration are less likely to occur when listening at diagonal front against a center line.

A speaker of the present invention includes:

a vibrating member which is supported by a support body as being vibratile, a voice coil which applies vibration force to the vibrating member, and a magnetic field generating portion which provide magnetic field to the voice coil;

wherein the vibrating member is ring-shaped having an internal peripheral edge and an external peripheral edge and vibration force is applied from the voice coil at least to the external peripheral edge;

a ring-shaped control member is disposed at the front in a sound-generating direction of the vibrating member; and pass space for sound waves to be generated from the vibrating member is formed respectively at an area surrounded by an internal peripheral end portion of the control member and an area outside an external peripheral end portion.

In the present invention, the pass space which is formed outside the external peripheral end portion of the control member is faced to the front in the sound-generating direction of the external peripheral edge of the vibrating member and the pass space which is surrounded by the internal peripheral end portion of the control member is faced to the front in the sound-generating direction of the internal peripheral edge of the vibrating member.

Further, in the present invention, the external peripheral end portion of the control member is located at the center side from the external peripheral edge of the vibrating member; and the internal peripheral end portion of the control member is located at the external peripheral side from the internal peripheral edge of the vibrating member.

In the speaker of the present invention, the ring-shaped control member is faced to the front of the ring-shaped vibrating member. When sound is listened from diagonal front being angled against the center line, a sound wave generated from a sound-generating portion at a position of the inclined side sandwiching the center line is more likely to be transmitted to a person through the pass space located outside the external peripheral end portion of the control member. However, propagation of a sound wave generated from a sound-generating portion at an opposite position to the inclined side is more likely to be suppressed. Accordingly, interference between sound waves from the bilateral sound-generating portions can be suppressed and sound pressure decrease and sound quality deterioration can be suppressed.

In contrast, when sound is listened at the front on the center line of the speaker, sound waves generated from the ring-shaped vibrating member are transmitted frontward through the pass space which is surrounded by the internal peripheral end portion of the control member, so that the sound waves are more likely to be transmitted to a person without causing phase difference.

In the present invention, it is preferable that an inclined side face be formed at the external peripheral end portion of the control member to be apart gradually from a center as getting away frontward in the sound-generating direction from the vibrating member.

With the above structure, the sound waves generated from the ring-shaped vibrating member are more likely to be guided to diagonally frontward as being guided by the inclined side face. Accordingly, when listening from the front being diagonal against the center line, decrease of the sound pressure level is easy to be suppressed.

In the present invention, it is preferable that an opposite inclined face be formed at an opposite portion of the control member being faced to the vibrating member so that distance against the vibrating member is increased gradually as getting away from the center.

In the above structure, resonance at the opposite portion between the vibrating member and the control member is less likely to occur, so that sound quality deterioration caused by the resonance is easy to be prevented.

In the present invention, the internal peripheral edge of the vibrating member is fixed to the support body; and the external peripheral edge has degree of freedom as being supported by the support body via a damper member. Alternatively, both of the internal peripheral edge and the external peripheral edge of the vibrating member are supported by the support body respectively via a damper member; and vibration force is separately applied to the internal peripheral edge and the external peripheral edge from separate voice coils.

A speaker of the present invention utilizes a ring-shaped vibrating member and is likely to prevent occurrence of sound pressure decrease and sound quality deterioration when listening sound from diagonal front.

DETAILED DESCRIPTION

Figure 1:
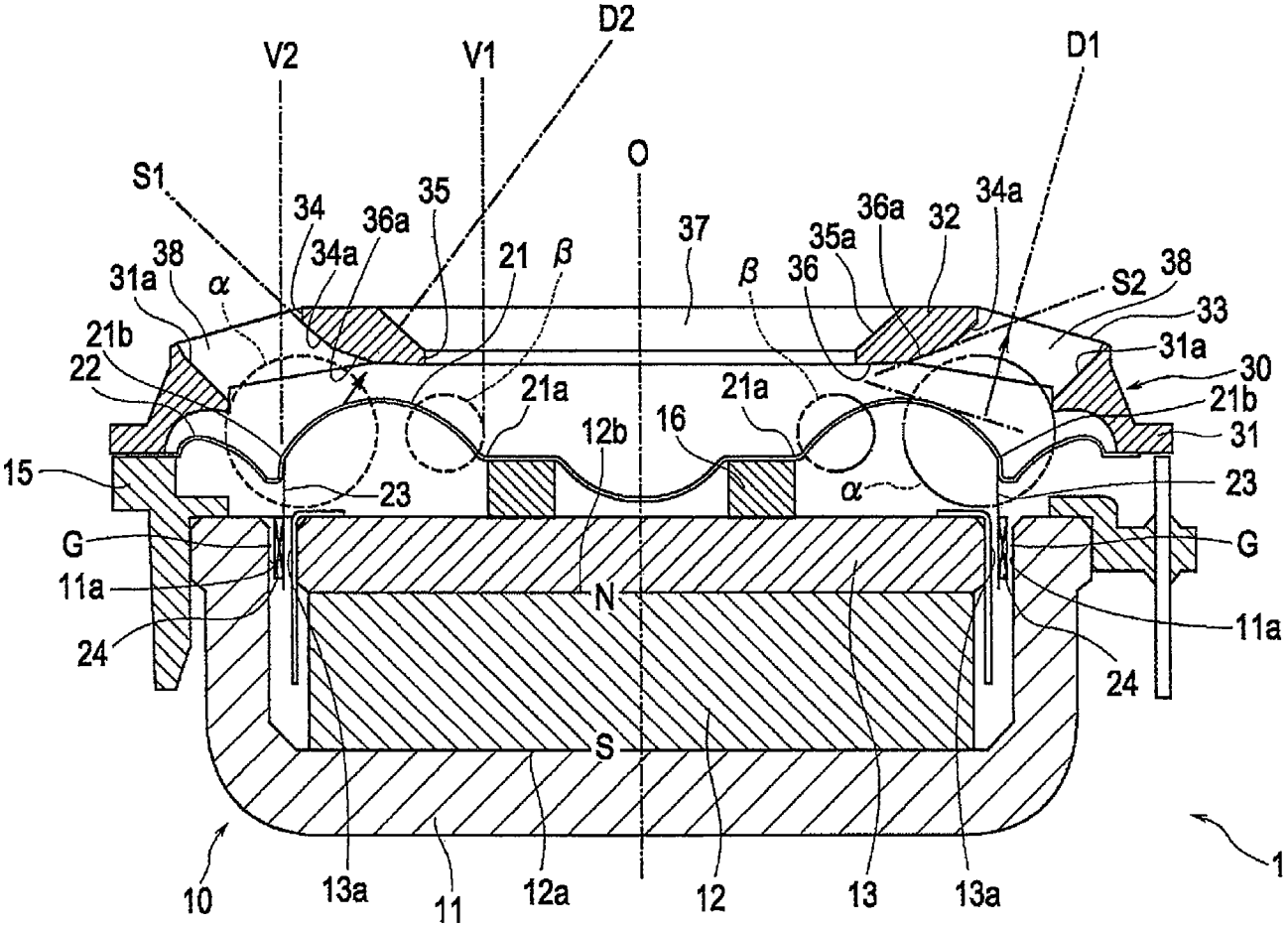
FIG. 1 is a longitudinal sectional view of a speaker of a first embodiment of the present invention.
Figure 2:
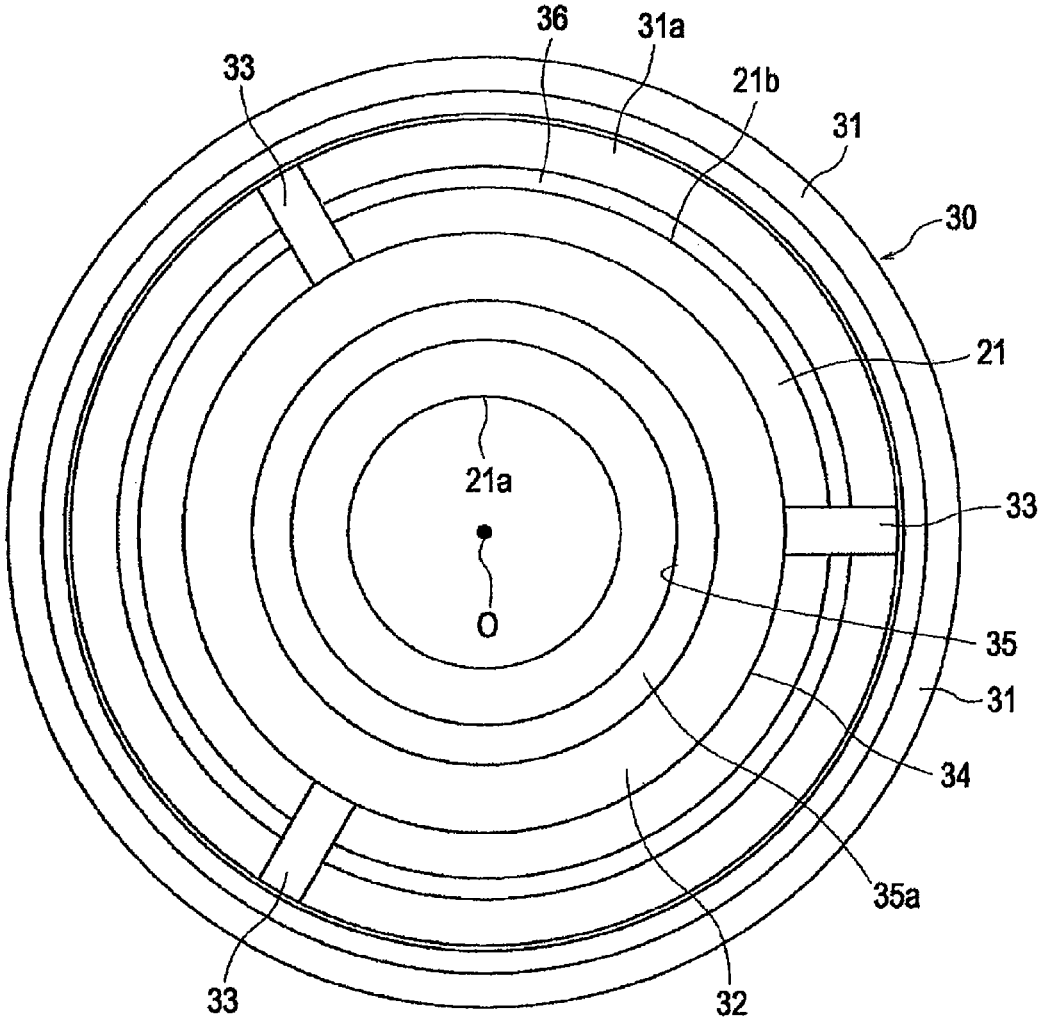
FIG. 2 is a front view of the speaker of the first embodiment.

A speaker 1 of the first embodiment illustrated in FIGS. 1 and 2 is used mainly for high-pitched tones.

The speaker 1 includes a magnetic field generating portion 10. The magnetic field generating portion 10 includes a magnetic-material-made lower yoke 11 of which center part is concavely formed, a disc-shaped magnet 12 which is disposed in the concave portion of the lower yoke 11, and a disc-shaped upper yoke 13 which is disposed on the magnet 12. The magnet 12 is magnetized in the direction so that polarities of a lower face 12*a* contacted to the lower yoke 11 and an upper face 12*b* contacted to the upper yoke 13 are to be opposite.

As illustrated in FIGS. 1 and 2, a line passing through the center of the disc-shaped upper yoke 13 is the center line O of the speaker 1.

An upper internal peripheral face 11*a* of the lower yoke 11 is cylindrical and an external peripheral face 13*a* of the upper yoke 13 is cylindrical, as well. Then, a magnetic gap G is formed at an opposed part between the upper internal peripheral face 11*a* and the external peripheral face 13*a*.

An outer support body 15 formed of non-magnetic material such as synthetic resin and non-ferrous metal is fixed to an upper external peripheral part of the lower yoke 11. An inner support body 16 formed of non-magnetic material such as synthetic resin and non-ferrous metal is fixed to a center part of an upper face of the upper yoke 13.

A vibrating member 21 is disposed between the outer support body 15 and the inner support body 16. The vibrating member 21 is formed of soft sheet material of cloth, non-woven fabric, paper, resin film or combined material thereof.

The vibrating member 21 being ring-shaped in a front view as illustrated FIG. 2 includes an internal peripheral edge 21*a* and an external peripheral edge 21*b*. The vibrating member 21 has a protruded shape as a center part between the internal peripheral edge 21*a* and the external peripheral edge 21*b* is protruded frontward.

The internal peripheral edge 21*a* of the vibrating member 21 is fixed to the inner support body 16. A damper member 22 is connected to the external peripheral edge 21*b* of the vibrating member 21. The damper member 22 is fixed to the external support body 15. As illustrated in FIG. 1, the damper member 22 is attached between the external peripheral edge 21*b* of the vibrating member 21 and the outer support body 15 so that the sectional shape thereof is curved. The damper member 22 may be integrally formed with the vibrating member 21 as being extended therefrom with the same material as that of the vibrating member 21. Alternatively, it is also possible that the damper member 22 is formed of different sheet material from that of the vibrating member 21 and is jointed to the external peripheral edge 21*b*.

The external peripheral edge 21*b* of the vibrating member 21 can be moved back and forth as being supported by the damper member 22. Since the internal peripheral edge 21*a* is fixed to the inner support body 16, degree of freedom of the vibrating member 21 is the highest at the external peripheral edge 21*b*. Further, since the damper member 22 is vibrated back and forth together with the vibrating member 21, the damper member 22 also functions as a part of the vibrating member 21.

As illustrated in FIG. 1, a cylindrical bobbin 23 is fixed to the external peripheral edge 21*b* of the vibrating member 21. A voice coil 24 is attached to the bobbin 23 and the voice coil 24 is inserted to the magnetic gap G.

An equalizer 30 is placed at the front of the speaker 1. The equalizer 30 is formed of non-magnetic material such as synthetic resin and non-ferrous metal. The equalizer 30 has a ring-shaped attaching portion 31 at the external peripheral part thereof as being fixed to a front end part of the external support body 15. As illustrated in FIG. 2, the equalizer 30 has a plurality of support ribs 33 integrally extending toward the center line O from the attaching portion 31. A ring-shaped control member 32 is integrally formed at distal portions of the respective support ribs 33.

As illustrated in FIG. 1, the ring-shaped control member 32 is faced to the front of a sound-generating side of the ring-shaped vibrating member 21 as being spaced therebetween. FIG. 1 illustrates a cylindrical internal peripheral vertical face V1 extending in parallel to the center line O frontward in the sound-generating direction from the internal peripheral edge 21*a* of the vibrating member 21 and a cylindrical external peripheral vertical face V2 extending in parallel to the center line O frontward from the external peripheral edge 21*b* of the vibrating member 21.

An external peripheral end portion 34 of the control member 32 is placed to the inner side being closer to the center line O than the external peripheral vertical face V2. An internal peripheral end portion 35 of the control member 32 is placed to the external peripheral side as being further apart from the center line O than the internal peripheral vertical face V1.

A ring-shaped outer pass space 38 through which a sound wave generated when the vibrating member 21 is vibrated passes is formed between the external peripheral end portion 34 of the control member 32 and the attaching portion 31. A circular inner pass space 37 through which a sound wave generated by the vibration of the vibrating member 21 passes frontward is formed at an area surrounded by the internal peripheral end portion 35 of the control member 32. The outer pass space 38 is faced to the front of the external peripheral edge 21*b* of the vibrating member 21 and the inner pass space 37 is faced to the front of the internal peripheral edge 21*a* of the vibrating member 21.

An inclined side face 34*a* is formed at the external peripheral end portion 34 of the control member 32. The inclination direction S1 of the inclined side face 34*a* is the direction being apart gradually from the center line O as approaching frontward in the sound-generating direction from the vibrating member 21. Further, an internal peripheral face 31*a* of the attaching portion 31 of the equalizer 30 is faced to the inclined side face 34*a*. The internal peripheral face 31*a* is also inclined to the same direction as the inclined side face 34*a*.

The outer pass space 38 is the space at which the inclined side face 34*a* and the internal peripheral face 31*a* are faced to each other. The space extends in the direction to be apart gradually from the center line O as getting away from the vibrating member 21. Owing to the outer pass space 38, a sound wave generated at the vicinity of the external peripheral edge 21*b* of the vibrating member 21 is more likely to be guided in the direction being apart from the center line O (i.e., the D1 direction). In addition, the sound wave generated at the vicinity of the external peripheral edge 21*b* is more likely to be disturbed from being propagated in the direction toward the center line O (i.e., the D2 direction).

Since the outer pass space 38 has the inclined side face 34*a*, opening area of a part faced to the vibrating member 21 is widened. In the present specification, the sentence of "the outer pass space 38 is faced to the front in the sound-generating side of the external peripheral edge 21*b* of the vibrating member 21" denotes that the opening portion of the outer pass space 38 oriented to the vibrating member 21 is faced to the external peripheral edge 21*b*. Under the above conditions, the external peripheral end portion 34 of the control member 32 may be placed at the external peripheral side from the external peripheral vertical face V2. Here, when the external peripheral end portion 34 is placed at the center line O side from the external peripheral vertical face V2 as illustrated in FIG. 1, the sound wave generated by the vibration at the vicinity of the external peripheral edge 21*b* of the vibrating member 21 is more likely to be propagated frontward along the external peripheral vertical face V2. Accordingly, a sufficient sound pressure level is more likely to be ensured when sound is listened at the front on the center line O.

As illustrated in FIG. 1, an opposite inclined face 36*a* is formed at an opposite portion 36 of the control member 32 being faced to the vibrating member 21. The inclination direction S2 of the opposite inclined face 36*a* is set so that opposed distance to the vibrating member 21 is gradually enlarged as getting away from the center line O. Owing to forming of the opposite inclined face 36*a*, the sound pressure generated by the vibration of the vibrating member 21 is effectively transmitted frontward through the outer pass space 38.

Further, in the case that the opposite inclined face 36*a* is formed, occurrence of unnecessary resonance within a small space between the opposite portion 36 and the vibrating member 21 is more likely to be prevented.

An inclined face 35*a* is formed at the internal peripheral end portion 35 of the control member 32. The inclined face 35*a* is formed in the direction to be gradually apart from the center line O as getting away frontward from the vibrating member 21. Owing to forming of the inclined face 35*a*, sound pressure to be transmitted frontward from the inner pass space 37 is more likely to be spread frontward. Further, in the case that the inclined face 35*a* is formed, occurrence of unnecessary resonance at the inner pass space 37 is more likely to be prevented, so that deterioration of sound quality due to resonance is more likely to be prevented.

In the speaker 1, when a sound signal is provided to the voice coil 24, vibration force is applied to the external peripheral edge 21*b* of the vibrating member 21 via the bobbin 23. Since degree of freedom of the vibrating member 21 is the highest at the external peripheral edge 21*b*, the external peripheral edge 21*b* is easy to be vibrated when a high frequency sound signal is applied. Accordingly, when treble sound is generated, sound pressure becomes the largest at the sound-generating portion of an area α.

When sound is listened on the center line O in front of the speaker 1, treble sound pressure generated at the area α is transmitted frontward as passing through the outer pass space 38 along the external peripheral vertical face V2. Accordingly, when listening on the center line O, treble sound pressure is high and sound quality is favorable with less sound distortion.

In contrast, when sound is listened in an angled direction (e.g., the D1 direction and the D2 direction) being deviated from the center line O, a treble sound wave generated from the area α at the right side of FIG. 1 is more likely to be listened for a person as being oriented in the D1 direction as passing through the outer pass space 38. On the other hand, a treble sound wave generated from the area α at the left side of FIG. 1 is less likely to be transmitted in the D2 direction as being disturbed by the control member 32 when being oriented in the D2 direction. A treble sound wave has high directivity. Accordingly, since the sound at the right side is preferentially listened and the sound at the left side is hard to be listened, treble sound waves generated from the separated areas α, α at the bilateral sides is less likely to be interfered. Therefore, decrease of treble sound pressure when listening at diagonal front can be suppressed and deterioration of sound quality can be improved.

Further, since the internal peripheral edge 21*a* of the vibrating member 21 is fixed to the inner support body 16, an area β being a sound-generating portion close to the internal peripheral edge 21*a* has low degree of freedom. Compared to the area α, sound pressure of a relatively low range is more likely to be formed in the area β. Directivity of sound waves of the relatively low range is not very strong and wavelength thereof is relatively long. Accordingly, sound waves capable of being transmitted frontward as passing through the internal pass space 37 from the area β are less likely to be interfered. Owing to wide opening of the inner pass space 37 in front of the area β, the sound pressure level of the relatively low range can be maintained at high. As a result, satisfactory sound quality can be obtained in a wide frequency range.

Figure 3:
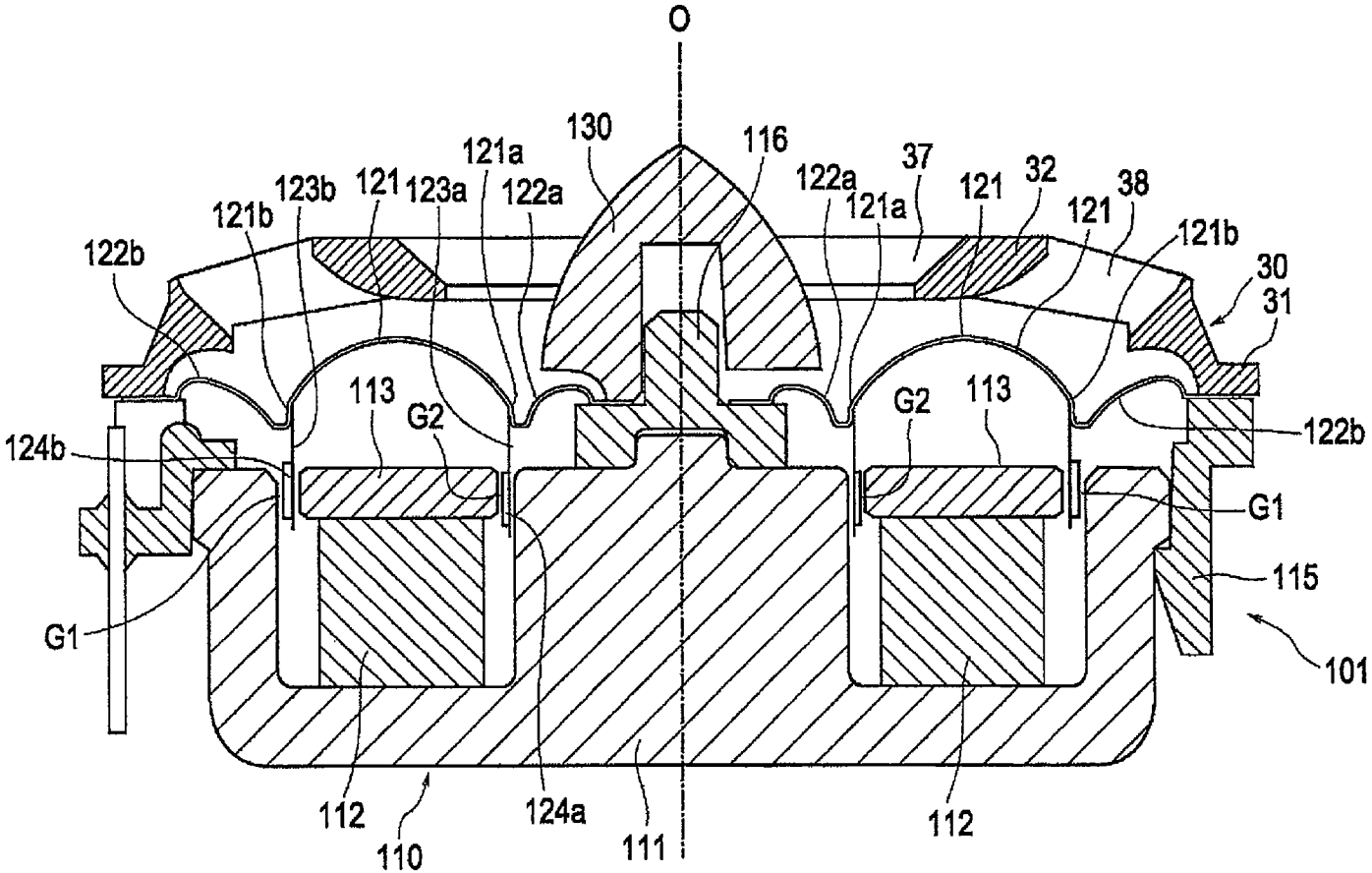
FIG. 3 is a longitudinal sectional view of a speaker of a second embodiment of the present invention.

In a speaker 101 of the second embodiment illustrated in FIG. 3, a magnetic-field generating portion 110 includes a lower yoke 111, a ring-shaped magnet 112, and a ring-shaped upper yoke 113. An external peripheral side magnetic gap G1 and an internal peripheral side magnetic gap G2 are formed between the lower yoke 111 and the upper yoke 113.

Regarding a ring-shaped vibrating member 121, an internal peripheral edge 121*a* thereof is supported by an inner support body 116 via a damper member 122*a* and an external peripheral edge 121*b* is supported by an outer support body 115 via a damper member 122*b*. A bobbin 123*a* is attached to the internal peripheral edge 121*a* of the vibrating member 121. A voice coil 124*a* attached to the bobbin 123*a* is inserted to the internal peripheral side magnetic gap G2. A bobbin 123*b* is attached to the external peripheral edge 121*b* of the vibrating member 121. A voice coil 124*b* attached to the bobbin 123*b* is inserted to the external peripheral side magnetic gap G1.

An equalizer 30 having the same structure as illustrated in FIG. 1 is attached to the outer support body 115. The equalizer 30 includes an attaching portion 31, a control member 32, an outer pass space 38 and an inner pass space 37 which are integrally formed therewith.

Further, a cone-shaped center equalizer 130 is attached to the inner support body 116. The center equalizer 130 is placed at the inner pass space 37.

In the speaker 101, since vibration force is applied to the internal peripheral edge 121*a* and the external peripheral edge 121*b* of the vibrating member 121 by the two voice coils 124*a*, 124*b*, the sound pressure level is heightened. With the speaker 101, the ring-shaped control member 32 is faced to the front of the vibrating member 121 as well. Accordingly, when sound is listened at the front being diagonal against the center line O, it is possible to suppress interference of sound waves generated from the external peripheral edge 121*b* of the vibrating member 121.

Examples

Figure 4:
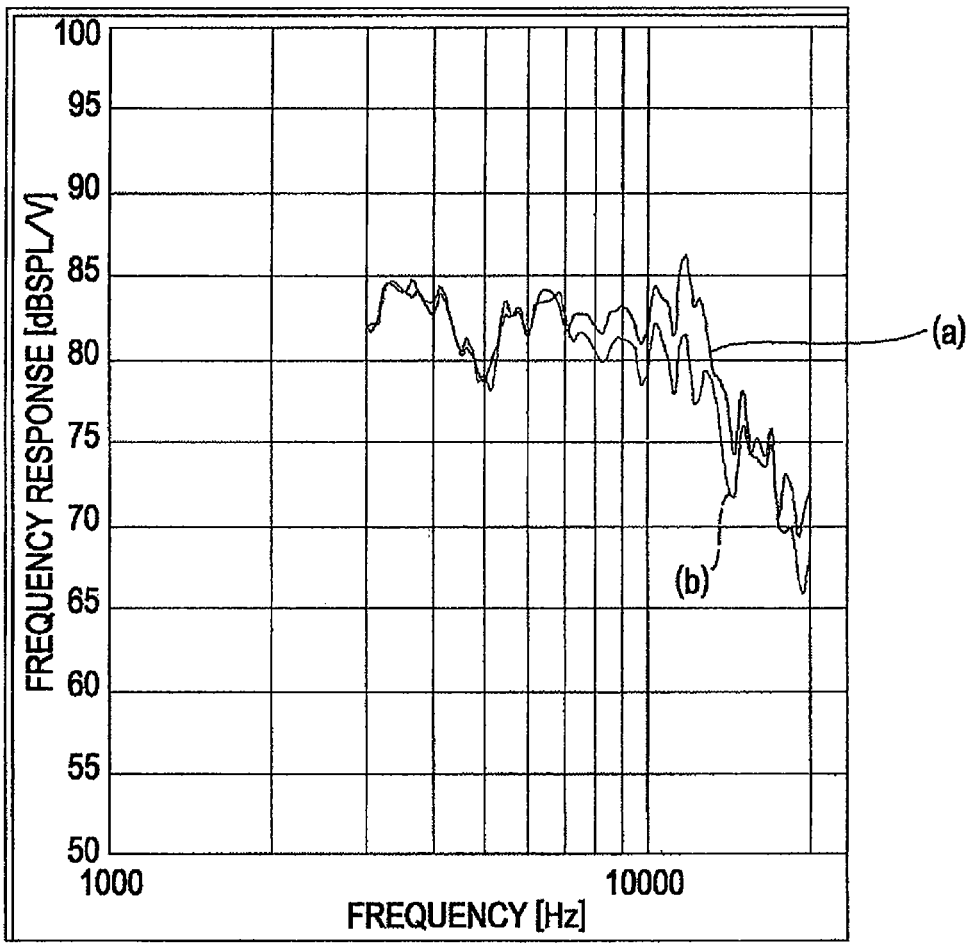
FIG. 4 is a graph indicating an effect of the present invention.

FIG. 4 is a graph of comparison between sound pressure levels of the speaker of the embodiment of the present invention and a speaker of the related art.

The speaker 1 of the embodiment has the structure as illustrated in FIG. 1. The external peripheral edge 21*b* of the vibrating member 21 is 25 mm in diameter. A speaker of the comparison example is the same as the speaker of the embodiment while the equalizer 30 is detached.

A high frequency signal of 1 watt was applied to the voice coil 24. The pressure levels were measured at a position being apart from the vibrating member 21 by 1 meter at diagonal front angled by 20 degrees from the center line as varying the frequency.

In FIG. 4, the horizontal axis denotes frequency and the vertical axis denotes a sound pressure level. A result of the embodiment is indicated by (a) and a result of the comparison example is indicated by (b). According to FIG. 4, it is perceptible that decrease of the sound level of the embodiment is suppressed while the sound level of the comparison example is decreased at the vicinity of 10 kHz.

Although preferred embodiments have been described in detail, the present invention is not limited to these specific embodiments. Rather, various modifications and changes can be made without departing from the scope of the present invention as described in the accompanying claims. Accordingly, all such modifications are intended to be included within the scope of this invention as defined in the following claims.

What is claimed is:

1. A speaker comprising:

a vibrating member supported by a support body, the support body having an outer peripheral wall;

a voice coil configured to apply a vibrational force to the vibrating member;

a magnetic field generating portion configured to provide a magnetic field to the voice coil, wherein the vibrating member is ring-shaped and has an internal peripheral edge and an external peripheral edge, and wherein the voice coil applies the vibrational force at least to the external peripheral edge of the vibrating member;

a single control member located radially inwardly from the outer peripheral wall of the support body;

the control member formed as a single contiguous ring suspended above a front portion of the vibrating member by a plurality of radially oriented support ribs, and located in a sound-generating direction relative to the vibrating member, the control member having a face inclined along a single direction and tapering along a center of the sound-generating direction;

the control member forming a first unobstructed pass space formed within and surrounded by an inner peripheral circumferential edge of the control member;

the control member forming a second unobstructed pass space formed at an area outside an outer peripheral circumferential edge of the control member, the first and second pass spaces configured to pass therethrough, sound waves generated by the vibrating member; and a cone-shaped equalizer disposed in concentric alignment with the control member and within the first pass space.

2. The speaker according to claim 1, wherein the second pass space faces forward relative to a sound-generating direction of the external peripheral edge of the vibrating member, and wherein the first pass space faces forward relative to a sound-generating direction of the internal peripheral edge of the vibrating member.

3. The speaker according to claim 2, wherein the outer peripheral circumferential edge of the control member is located at a center side from the external peripheral edge of the vibrating member; and wherein the inner peripheral circumferential edge of the control member is located at an external peripheral side from the internal peripheral edge of the vibrating member.

4. The speaker according to claim 3, wherein a first inclined side face is formed at the outer peripheral circumferential edge of the control member and tapers gradually away from a center of the sound-generating direction.

5. The speaker according to claim 4, wherein a second inclined face is formed opposite the first inclined face and tapers gradually away from a center of the sound-generating direction.

6. The speaker according to claim 5, wherein the internal peripheral edge of the vibrating member is fixed to the support body; and wherein the external peripheral edge of the vibrating member is flexibly supported by the support body via a damper member.

7. The speaker according to claim 5, wherein the internal peripheral edge of the vibrating member and the external peripheral edge of the vibrating member are supported by the support body, respectively, via a damper member; and wherein vibrational force is applied to the internal peripheral edge and the external peripheral edge, respectively, from separate voice coils.

8. The speaker according to claim 4, wherein the internal peripheral edge of the vibrating member is fixed to the support body; and wherein the external peripheral edge of the vibrating member is flexibly supported by the support body via a damper member.

9. The speaker according to claim 4, wherein the internal peripheral edge of the vibrating member and the external peripheral edge of the vibrating member are supported by the support body, respectively, via a damper member; and wherein vibrational force is applied to the internal peripheral edge and the external peripheral edge, respectively, from separate voice coils.

10. The speaker according to claim 2, wherein a first inclined side face is formed at the outer peripheral circumferential edge of the control member and tapers gradually away from a center of the sound-generating direction.

11. The speaker according to claim 10, wherein a second inclined face is formed opposite the first inclined face and tapers gradually away from a center of the sound-generating direction.

12. The speaker according to claim 11, wherein the internal peripheral edge of the vibrating member is fixed to the support body; and wherein the external peripheral edge of the vibrating member is flexibly supported by the support body via a damper member.

13. The speaker according to claim 11, wherein the internal peripheral edge of the vibrating member and the external peripheral edge of the vibrating member are supported by the support body, respectively, via a damper member; and wherein vibrational force is applied to the internal peripheral edge and the external peripheral edge, respectively, from separate voice coils.

14. The speaker according to claim 10, wherein the internal peripheral edge of the vibrating member is fixed to the support body; and wherein the external peripheral edge of the vibrating member is flexibly supported by the support body via a damper member.

15. The speaker according to claim 10, wherein the internal peripheral edge of the vibrating member and the external peripheral edge of the vibrating member are supported by the support body, respectively, via a damper member; and wherein vibrational force is applied to the internal peripheral edge and the external peripheral edge, respectively, from separate voice coils.

* * * * *